United States Patent [19]

Tomita

[11] Patent Number: 4,577,597

[45] Date of Patent: Mar. 25, 1986

[54] METHOD AND APPARATUS FOR SUPPLYING FUEL TO INTERNAL COMBUSTION ENGINE

[75] Inventor: Takao Tomita, Niiza, Japan

[73] Assignee: Honda Giken Kogyo Kabushiki Kaisha, Tokyo, Japan

[21] Appl. No.: 387,553

[22] Filed: Jun. 11, 1982

[30] Foreign Application Priority Data

Jun. 18, 1981 [JP] Japan ..... 56-94457
Jun. 22, 1981 [JP] Japan ..... 56-96329

[51] Int. Cl.[4] ..... F02B 33/00; F02D 1/00

[52] U.S. Cl. ..... 123/73 A; 123/332; 123/198 DB

[58] Field of Search ..... 123/64, 73 A, 325, 332, 123/333, DIG. 11, 198 DB, 73 SP, 439, 65 R, 436, 446

[56] References Cited

U.S. PATENT DOCUMENTS

| | | | |
|---|---|---|---|
| Re. 22,863 | 4/1947 | Mallory | 123/64 |
| 1,552,138 | 9/1925 | Giannattasio | 123/332 |
| 1,598,891 | 9/1926 | Stokes | 123/73 A |
| 1,825,959 | 10/1931 | Kondo | 123/64 |
| 2,420,136 | 5/1947 | Hill | 123/64 |
| 3,455,260 | 7/1969 | Mennesson | 123/333 |
| 4,185,598 | 1/1980 | Onishi | 123/73 A |
| 4,207,845 | 6/1980 | Semmler | 123/325 |
| 4,253,437 | 5/1981 | Haramoto | 123/325 |
| 4,411,233 | 10/1983 | Chenet et al. | 123/439 |

*Primary Examiner*—Magdalen Y. C. Moy
*Assistant Examiner*—David A. Okonsky
*Attorney, Agent, or Firm*—Armstrong, Nikaido, Marmelstein & Kubovcik

[57] ABSTRACT

Method and apparatus for supplying fuel to an internal combustion engine, which engine performs strokes for suction, compression, expansion and exhaust in sequence. The method comprises alternatingly supplying fuel to the engine and suspending the fuel supply to the engine in successive suction strokes. In a heavy load range of operation of the engine, the fuel can be supplied in each of the successive suction strokes. Various different embodiments of the apparatus for performing the above method are disclosed.

15 Claims, 7 Drawing Figures

METHOD AND APPARATUS FOR SUPPLYING FUEL TO INTERNAL COMBUSTION ENGINE

BACKGROUND AND SUMMARY OF THE INVENTION

The present invention relates to a method of supplying fuel to an internal combustion engine, such as a two-cycle engine or a four-cycle engine, as well as to a control apparatus for supplying the fuel.

In an internal combustion engine of the mentioned type, there is a demand for decreasing the rate of fuel consumption with minimal reduction of power and to prolong the life of the engine by diminishing the thermal load.

Accordingly, an object of the invention is to provide a novel method of, and apparatus for, supplying fuel to internal combustion engine wherein the fuel supply to the engine is stopped intermittently to supply only fresh air to the engine to completely scavenge the combustion gas residing in the combustion chamber. This remarkably improves the scavenging efficiency and intake efficiency of the engine, while providing an efficient cooling of the engine by the fresh air, thereby to meet the above-stated demand.

Another object of the invention is to provide a novel method of, and apparatus for, supplying fuel to an internal combustion engine wherein, in the heavy load operating range of the engine, fuel is supplied to the engine in each suction stroke as in the case of ordinary engines while, in the light and medium operating range of the engine, the fuel supply to the engine is suspended periodically to satisfy the above-mentioned demand.

BRIEF DESCRIPTION OF THE DRAWINGS

The above and other objects and the attendant advantages of the present invention will become readily apparent by reference to the following detailed description when considered in conjunction with the accompanying drawings wherein.

BRIEF DESCRIPTION OF THE PREFERRED EMBODIMENTS

Figure 1:
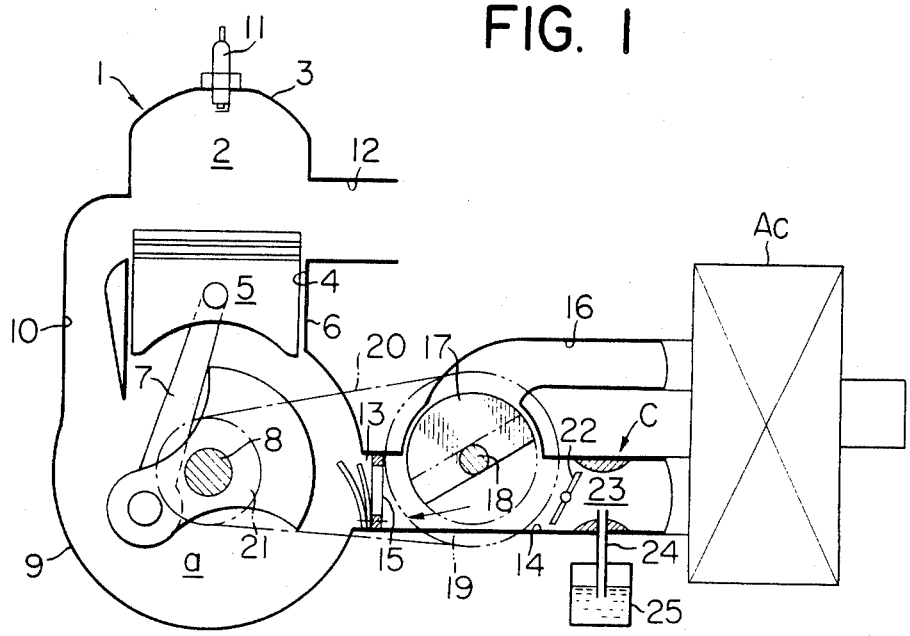
FIG. 1 is a schematic vertical sectional side elevational view of a fuel supply apparatus for two-cycle internal combustion engine in accordance with a first embodiment of the invention.

Hereinunder a description will be made as to a first embodiment of the present invention with specific reference to FIG. 1. A two-cycle internal combustion engine 1 is composed of a cylinder head 3 in which a combustion chamber 2 is formed, a cylinder block 6 having a cylinder 4 receiving a piston 5 and a crank case 9 accommodating a crank shaft 8 connected to the piston 5 through a connecting rod 7.

A scavenging passage 10 providing a communication between the cylinder 4 and the crank chamber (a) in the crank case 9 is formed in the side wall of the cylinder block 6. An exhaust passage 12 is formed in the cylinder 4.

A sparking plug 11 screwed to the cylinder head 3 has electrodes facing a combustion chamber 2.

A first intake passage 14 provided at its intermediate portion with a carburetor C is connected to an intake port 13 opening to the crank chamber (a) of the engine 1, through a reed valve 15 which is adapted to be opened in the suction stroke in which the piston 5 moves upward, thereby to suck the air-fuel mixture into the crank chamber (a).

A second intake passage 16 is connected to a portion of the first intake passage 14 downstream from the carburetor C through a rotary type stop valve 17 having a semi-circular cross-section. This stop valve 17 has a valve shaft 18 to which is fixed a driven wheel 19 adapted to be driven through an endless belt 20 by a driving wheel 21 fixed to the crank shaft 8. The ratio of the diameter between the driving wheel 21 and the driven wheel 19 is selected to be 1:2 and the rotary stop valve 17 is adapted to be rotated at a speed which is one-half that of the crank shaft 8. The outer ends of the first intake passage 14 and the second intake passage 16 are connected to the atmosphere through an air cleaner common to these intake passages 14 and 16.

In FIG. 1, a throttle valve 22, venturi portion 23, a fuel injection nozzle 24 and a float chamber 25 are the major parts of the carburetor C.

The operation of the first embodiment is as follows:

Suppose that the two-cycle internal combustion engine shown has just started to rotate the crank shaft 8. As a result, the rotary type stop valve 17 is rotated at a speed which is one-half that of the crank shaft 8 through the driving wheel 21, endless belt 20 and the driven wheel 19. In this manner, the first intake passage 14 and the second intake passage 16 are alternatingly opened and closed for each rotation of the crank shaft 8. In the suction/compression stroke in which the piston 5 moves upward, if the stop valve 17 is substantially open to the first passage as indicated by full line in FIG. 1, the air-fuel mixture produced in the carburetor C is sucked into the crank chamber (a) by the vacuum generated in the latter. Then as the engine commences the expansion/exhaust (scavenging) stroke, the piston 5 is lowered so that the exhaust passage 12 and the scavenging passage 10 are allowed to communicate with the cylinder chamber 4 defined on the piston 5. The mixture which has been supplied to the crank chamber (a) is compressed by the piston 5 moving downward and flows upwardly through the scavenging passage 10 into the cylinder chamber 4, thereby to scavenge the combustion gas while filling the cylinder chamber 4. As the engine starts the next stroke, the rotary stop valve 17 which has been rotated 180° in the preceding stroke, closes the first intake passage 14 and permits the second intake passage 16 to be communicated with the crank chamber (a). Therefore, in the suction/compression stroke in which the piston 5 moves upward, only fresh air is introduced into the crank chamber (a) through the second intake passage 16. Consequently, in the subsequent expansion/exhaust (scavenging) stroke in which the piston 5 moves downward, almost only the fresh air is introduced into the engine to sufficiently scavenge the cylinder chamber 4 while effectively cooling the same. Although the sparking plug makes an ignition, no explosion/combustion takes place in the combustion chamber.

Figure 2:
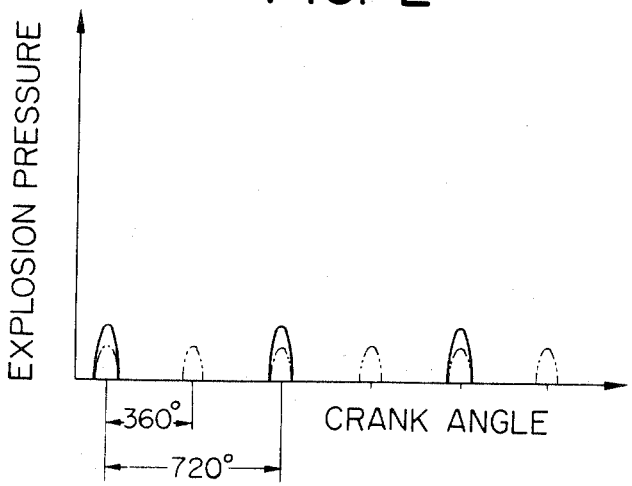
FIG. 2 is a diagram showing the interval of combustion in the engine having the apparatus of the invention in comparison with that of the conventional engine.

Thus, in the described first embodiment of the invention, the explosion and combustion takes place once in two revolutions of the crank shaft 8. This means that the frequency of the explosion is one-half that in a conventional two-cycle internal combustion engine. This relation will be most clearly seen from FIG. 2. More specifically, in this Figure, the axis of the abscissa represents the crank angle while the axis of ordinate represents the effective explosion pressure. The interval of explosion in the engine under the fuel supply control of this embodiment will be seen from the full-line curve, while the explosion interval in the conventional engine is shown by chain line. The reason why the effective explosion pressure is higher in the engine under the fuel supply control of the invention than in the conventional engine is that the combustion of the mixture is made at a high efficiency because of the high efficiency of scavenging conducted solely by the fresh air. Thus, in the engine under the fuel supply control of the invention, the rate of fuel consumption is reduced to one half of that of a conventional engine, while the output power is higher than one half of that of a conventional engine.

Thus, in the described first embodiment, frequency of explosion is reduced to one half of that in a conventional two-cycle engine, so that it suffices only to supply the fuel at a rate which is about one-half. In consequence, the rate of fuel consumption is decreased remarkably. Furthermore, the cooling of the cylinder is effectively promoted by the fresh air in the stroke in which the explosion does not take place. In addition, the scavenging effect is improved to ensure a higher combustion efficiency in the stroke in which the explosion takes place.

Although in the described embodiment the ratio of revolution speed between the crank shaft 8 and the rotary stop valve is set at 2:1, this ratio is not exclusive and can be varied freely as desired.

Figure 3:
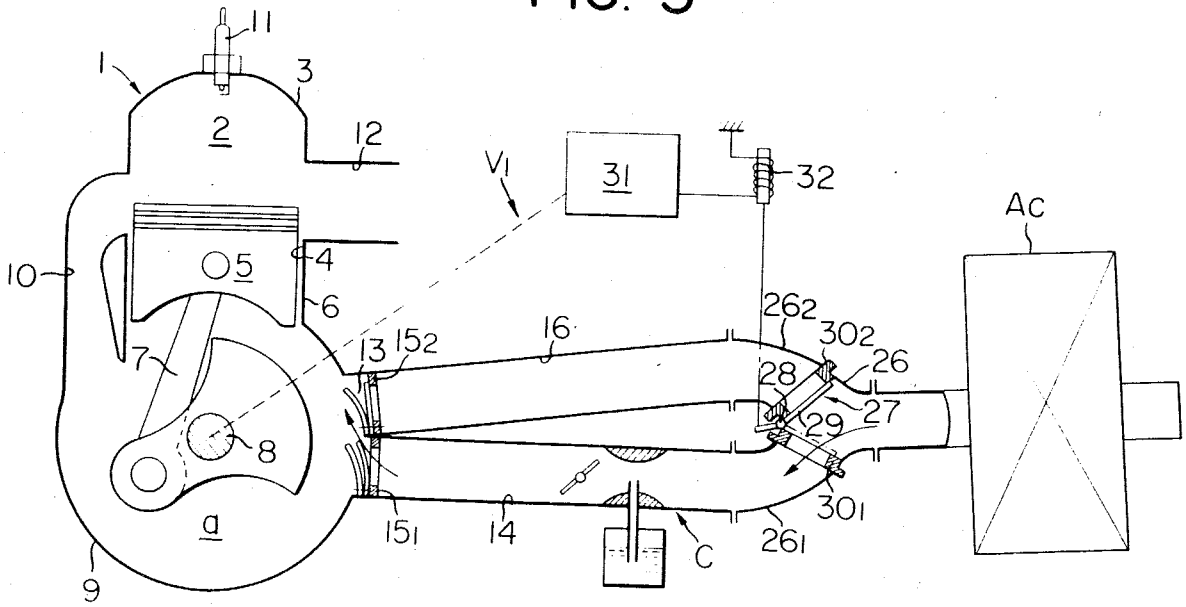
FIG. 3 is a schematic vertical sectional side elevational view of a second embodiment of the invention.

FIG. 3 shows a second embodiment of the invention in which a first intake passage 14 and a second intake passage 16 extending in a side-by-side relation communicate an intake port 13 opening to the inside of a crank case 9. Reed valves $\mathbf{15}_1$ and $\mathbf{15}_2$ are provided at the points of communication between these passages and the intake port to permit the fluid mixture to flow only in the direction from outside to inside of the crank chamber (a). A carburetor C is disposed at an intermediate portion of the first intake passage 14. Branch pipes $\mathbf{26}_1$ and $\mathbf{26}_2$ of a bifurcated connection pipe 26 are connected to the outer ends of the first and second intake passages 14 and 16. The upstream end of the bifurcated pipe 26 is connected to an air cleaner Ac which is communicated with the atmosphere. A switching valve 27 disposed at the juncture between the branch pipes $\mathbf{26}_1$ and $\mathbf{26}_2$ to open and close these branch pipes alternatingly. This change-over valve 27 consists of a flap valve member 29 pivoted to the juncture of the bifurcated pipe 26 and two valve seats opening to respective branch pipes $\mathbf{26}_1$ and $\mathbf{26}_2$ and denoted by numerals $\mathbf{30}_1$ and $\mathbf{30}_2$, respectively. The flap member 29 is adapted to open and close the first and second intake passages 14 and 16 alternatingly in accordance with the revolution of the crank shaft of the engine by a valve actuating device $V_1$ known per se operatively connected to the crankshaft. For instance, the first and second intake passages 14 and 16 are opened and closed alternatingly, while the engine crank shaft 8 makes one revolution. Namely, pulses representing the revolution of the crank shaft 8 are inputted into a central processing unit 31 consisting of a microcomputer which is known per se. The central processing unit 31 then provides controlling electric current which energizes a solenoid 32 to thereby switch the flap valve member 29 to the left or right. The frequency of switching between the first and second intake passages 14 and 16 is suitably set in accordance with the revolution speed of the crank shaft 8.

The switching valve 27 opens and closes the first and second intake passages 14 and 16 alternatingly at each time the engine commences the suction stroke. When the second intake passage 16 is kept closed, the fresh air from the air cleaner is introduced only into the first intake passage 14 so that the air fuel mixture formed in the carburetor C is introduced into the crank chamber (a). To the contrary, if the first intake passage 14 is closed by the switching valve 27 in the suction stroke, only the fresh air is introduced into the crank chamber (a) through the second intake passage 16. Therefore, in the engine under the fuel supply control of this embodiment, the explosion is periodically suspended by the repetition of supply and cut-off of the fuel in the suction stroke, as in the case of the first embodiment.

Figure 4:
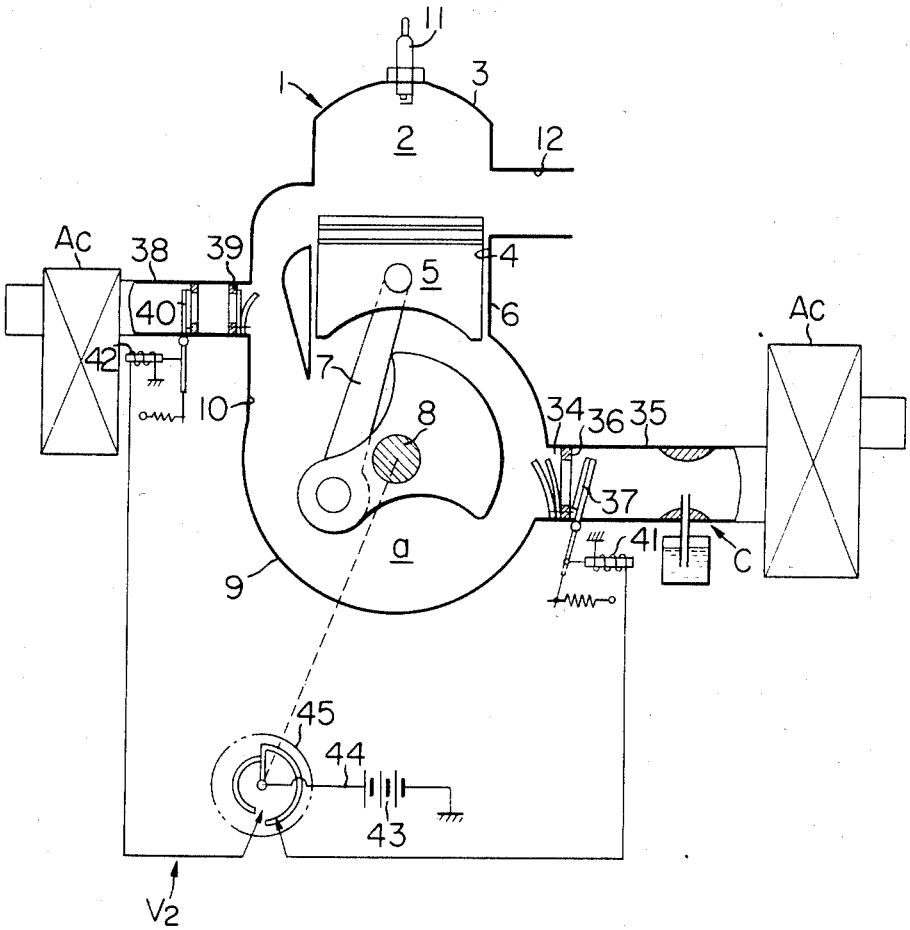
FIG. 4 is a schematic vertical sectional view of a third embodiment of the invention.

FIG. 4 shows a third embodiment of the invention in which a first intake passage 35 is provided to communicate with an intake port 34 opening to the crank chamber (a) of a two-cycle internal combustion engine. A reed valve 36, which permits the air to flow only in the direction from the outside to the inside of the crank chamber (a), is provided at the juncture between the intake port 34 and the first intake passage 35. The other end of the first intake passage 35 is opened to the atmosphere through an air cleaner Ac. The first intake passage 35 is provided at its intermediate portion with a carburetor C and a first stop valve 37 disposed downstream from the carburetor C and adapted to open and close the passage 35. A second intake passage 38 is connected to an intermediate portion of the scavenging passage 10, which provides a communication between the crank chamber (a) and the cylinder 4. A reed valve 39 is provided at the point of the communication to permit the air to flow only in the direction from the outside to the inside of the scavenging passage 10. The second intake passage 38 is communicated at its outer end to the atmosphere through an air cleaner Ac. A second stop valve 40 capable of opening and closing the passage 38 is disposed at an intermediate portion of the second intake passage 38.

The first and the second stop valves 37 and 40 are adapted to be opened and closed alternatingly by a common valve actuating mechanism $V_2$. More specifically, solenoids 41 and 42 for actuating the first and the second stop valves 37 and 40 are connected to the outer ends of these valves 37 and 40. These solenoids are connected to an electric power circuit 44 which, in turn, is connected to the battery 43. A rotary switch 45 is disposed at an intermediate portion of the power source circuit 44. The rotary switch 45 is operatively connected to the crank shaft 8 of the engine.

As the crank shaft 8 starts to rotate by starting of the engine, the rotary switch 45 rotates to connect the first and the second solenoids 41 and 42 alternatingly to the power source circuit 44, thereby to open and close the first and second stop valves 37 and 40 alternatingly. When the first stop valve 37 is opened, the air fuel mixture produced in the carburetor C is introduced into the crank chamber (a) through the first intake passage 35 during the suction stroke of the engine. On the other hand, if the second stop valve 40 is opened, only the fresh air is introduced into the crank chamber (a) through the second intake passage 38 and the scavenging passage 10 in the suction stroke of the engine. In consequence, the explosion is suspended periodically. The interval of opening and closing of the first and second stop valves 37 and 40 in relation to the revolution of the crank shaft 8 can be suitably selected also in this embodiment.

In this embodiment, as the engine commences the suction stroke in the state in which the first stop valve 37 is closed while the second stop valve 40 is opened, only fresh air is introduced through the second intake passage 38 into the scavenging passage 10. Therefore, the fresh air is concentrated to the area around the scavenging passage 10 and there is no fear that the mixture is sucked into the crank chamber (a) through the first intake passage 35. Then, as the engine commences its scavenging stroke, the cylinder chamber 4 is scavenged solely by the fresh air and the crank chamber (a) is charged with the mixture in the subsequent suction stroke, so that the scavenging efficiency is further improved and the rate of fuel consumption is further decreased as compared with the second embodiment of the invention.

Figure 5:
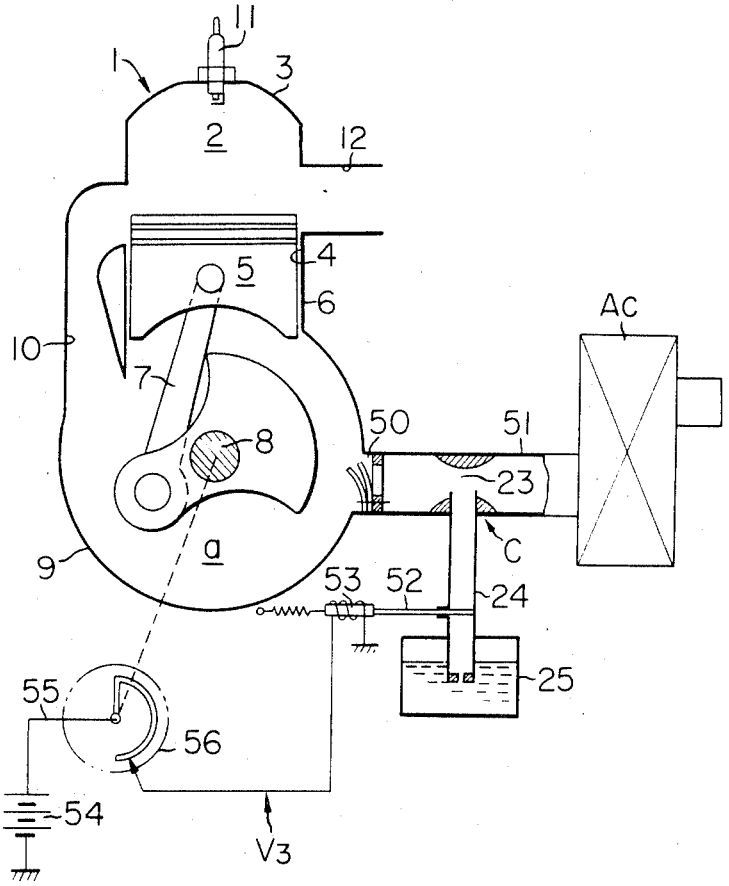
FIG. 5 is a schematic vertical sectional side elevational view of a fourth embodiment of the invention.

FIG. 5 shows a fourth embodiment of the invention in which an intake passage 51 is connected to an intake port 50, which opens to the crank case 9. The intake passage 51 is opened to the atmosphere through a carburetor C provided at an intermediate portion thereof. The carburetor C has a venturi portion 23 and a float chamber 25, which are communicated with each other through a fuel injection nozzle 24, which is adapted to be opened and closed by a slidable stop valve 52 provided at an intermediate portion thereof. The stop valve 52 is connected to a valve actuator $V_3$. More specifically, the stop valve 52 is operatively connected to a solenoid 53 which, in turn, is electrically connected to a power source circuit 55 connected to a battery 54. A rotary switch 56 disposed at an intermediate portion of the power source circuit 55 is operatively connected to the crank shaft 8 of the engine and is adapted to be turned on and off in accordance with the revolution of the crank shaft 8, thereby to operate the valve actuator $V_3$ to open and close the stop valve 52. The frequency of opening and closing of the stop valve 52 is suitably set in accordance with the revolution speed of the crank shaft 8.

When the engine is in its suction stroke, if the power source circuit 55 is closed, the solenoid 53 is energized and the stop valve 52 is pulled to open while the fuel injection nozzle 24 of the carburetor C is opened. Therefore, the fuel is injected into the intake passage 51 through the nozzle 24 and the carburetor C operates in a manner known per se to form the air-fuel mixture which is to be delivered into the crank chamber (a) through the intake passage 51. In contrast thereto, if the power source circuit 55 is opened in the suction stroke of the engine, the solenoid 53 is de-energized to close the stop valve 52. In this case, no jetting of fuel into the passage 51 takes place even though the vacuum is generated in the venturi portion 23 of the intake passage 51. Thus, only fresh air is introduced into the crank chamber (a) through the intake passage 51.

In this fourth embodiment, it is possible to obtain a remarkably high response or follow-up characteristics of the apparatus in relation to the operation of engine because the stop valve 52 can have a sufficiently short stroke. In addition, the construction of the apparatus can be very much simplified because only one intake passage 51 is necessitated.

Figure 6:
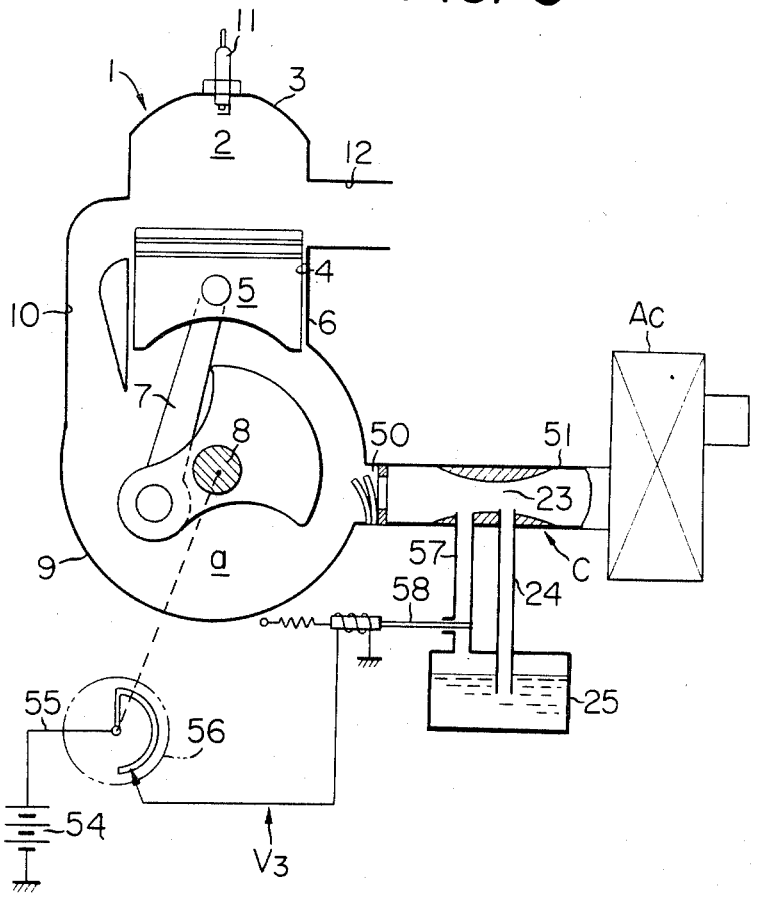
FIG. 6 is a schematic vertical sectional side elevational view of a fifth embodiment of the invention.

FIG. 6 shows a fifth embodiment of the invention in which, as in the case of the preceding fourth embodiment, an intake passage 51 communicating with the atmosphere opens to the crank case 9 of the two-cycle internal combustion engine and a carburetor C is provided at an intermediate portion of the intake passage 51. The venturi portion 23 and the float chamber 25 of the carburetor C are communicated with each other through a fuel injection nozzle 24, as well as through a communication passage 57. The communication passage 57 serves to equalize the pressures in the venturi portion 23 and the float chamber 25. A stop valve 58 adapted to open and close the communication passage 57 is disposed at an intermediate portion of the latter. As in the case of the fourth embodiment, the stop valve 58 is adapted to be opened and closed in accordance with the revolution speed of the engine crank shaft 8 by a valve actuator $V_3$. In the suction stroke of the engine, if the stop valve 58 is kept closed, the carburetor C operates in a manner known per se to permit the fuel injection into the venturi 23 so that the air fuel mixture is introduced into the crank chamber (a) through the suction passage 51. In contrast thereto, if the stop valve 58 is opened in the suction stroke of the engine, the communication passage 57 is opened to establish an equilibrium of the pressure between the venturi portion and the float chamber 25 so that the fuel is not sucked. Therefore, solely fresh air is introduced into the crank chamber (a) through the intake passage 51.

In this fifth embodiment, the float chamber 25 and the venturi portion 23 of the carburetor C are communicated with each other not only through the fuel injection nozzle 24 but also through the communication passage 57 having a stop valve 58 therein. It is, therefore, possible to effect the adjustment of the carburetor C in the same manner as the carburetor without imposing any restriction in the precision and size of the carburetor.

Figure 7:
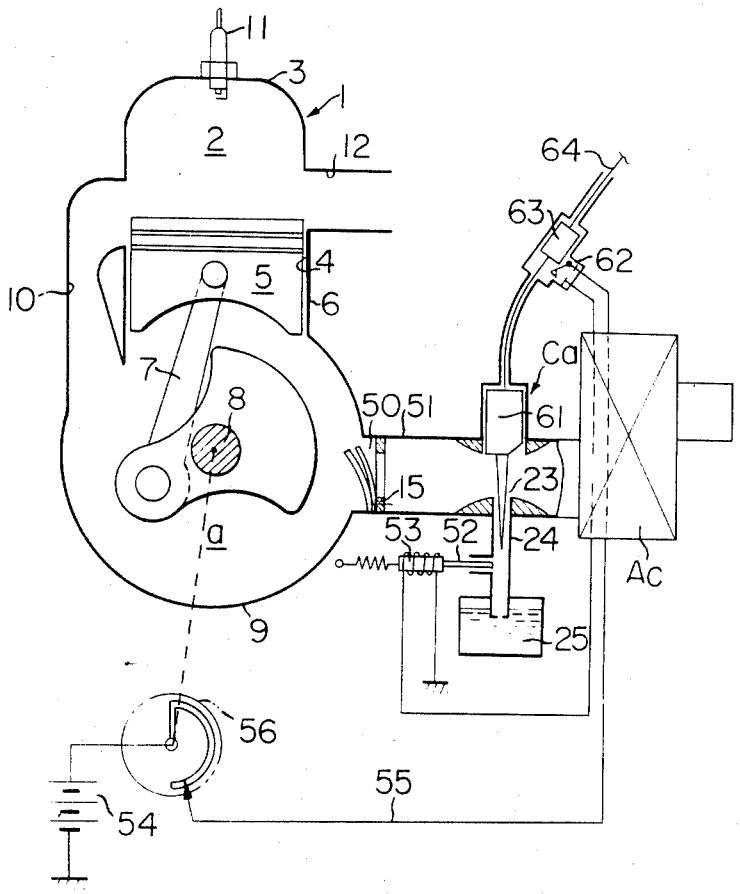
FIG. 7 is a schematic vertical sectional side elevational view of a sixth embodiment of the invention.

FIG. 7 shows a sixth embodiment of the invention in which an intake passage 51 is connected to an intake port 50 opening to a crank case 9 of an engine. A reed valve 15 disposed at the point of connection is adapted to permit the intake flow to flow only in the direction from the intake passage 51 into the crank chamber (a). A carburetor Ca of AMAL type i.e. a carburetor having a piston-shaped throttle valve, is disposed at an intermediate portion of the intake passage 51. The outer end of the intake passage 51 is connected to the atmosphere through an air cleaner Ac. A venturi portion 23 and a float chamber 25 of the carburetor Ca are connected to each other through a fuel passage 24 which is adapted to be opened and closed by a slide stop valve 52. The stop valve 52 is operatively connected to a solenoid 53 which, in turn, is electrically connected to a power source circuit 55 connected to a battery 54. A rotary switch 56 disposed at an intermediate portion of the power source circuit 55 is operatively connected to the crank shaft 8 of the engine and is turned on and off in accordance with the revolution speed of the crank shaft as in the case of the fourth embodiment.

Another switch 62 is disposed at an intermediate portion of the power source circuit 55. This switch 62 is adapted to be closed by an actuator 63 which is connected to an intermediate portion of the operation cable 64 leading from an operator's position (not shown) to a throttle valve 61 of the AMAL type carburetor Ca. When the throttle valve 61 is opened fully or almost fully, the actuator 63 is kept away from the switch 62 to permit the switch 62 to open. On the other hand, when the throttle valve 61 is in the partial opening position or an idling position, the stop valve 62 is kept closed by the actuator 63.

The apparatus of this sixth embodiment operates in the manner explained hereinbelow:

When the two-cycle engine is operated with light or medium load with the throttle valve 61 of the carburetor Ca in the idle or partial opening position, the switch 62 is kept closed by an actuator 63. The revolution of the crank shaft 8 activates the rotary swtich 56. For instance, the power source circuit 55 is opened and closed in each revolution of the crank shaft 8, i.e., in each combustion cycle of the two-cycle engine and the slide stop valve 52 opens and closes in each suction/-compression stroke.

In the suction/compression stroke in which the piston 5 moves upward, if the power circuit 55 is opened, the slide stop valve 52 is opened to open the fuel passage 24 of the carburetor Ca so that the fuel in the float chamber 25 is jetted into the intake passage 51 through the fuel passage 24. Namely, the carburetor Ca operates in the manner known per se to form an air fuel passage 51 and then into the crank chamber (a). Then as the power source circuit 55 is closed in the subsequent suction stroke, the solenoid 53 is energized to stop the slide stop valve 52. In this case, therefore, fuel does not jet into the passage 51 even though a vacuum is generated in the venturi portion 23 of the intake passage 51 so that air solely is introduced into the crank chamber (a) through the suction passage 51. In the subsequent expansion/scavenging stroke in which the piston 5 moves downward, only fresh air is introduced into the cylinder chamber 4 and, hence, no explosion takes place in the combustion chamber 2. In this stroke, therefore, the cylinder chamber 4 is sufficiently scavenged and is cooled effectively by the fresh air.

In the foregoing description of this embodiment, the supply of the fuel and the suspension of the fuel supply are repeated alternatingly in the light and medium load operation of the engine in which the throttle valve 61 takes the idle or partial opening position. The period of suspension of fuel supply, however, can be selected as desired.

Then as the engine operation is shifted to heavy load operation with the throttle valve 61 opened fully or almost fully, the switch 62 is opened to open the power source circuit 55 to keep the slide valve 52 open so that the carburetor Ca forms the air fuel mixture in each suction stroke as in the case of ordinary engine and delivers the same into the crank chamber (a). In consequence, the explosion of mixture takes place in each combustion stroke as in the case of the ordinary two-cycle engine to provide high output power of the engine.

Although the embodiments heretofore described are applied to two-cycle engines, needless to say the invention can apply also to four-cycle internal combustion engines and rotary piston engines. The carburetors C and Ca may be substituted by suitable fuel injectors.

As has been described according to one aspect of the invention, the fuel supply to the internal combustion engine is periodically suspended in successive suction strokes of the engine so that the explosion is intermittently suspended in the successive combustion strokes. In the combustion stroke in which the explosion is suspended, the combustion gas remaining in the combustion chamber is effectively expelled and the cooling of the cylinder is effectively promoted by the introduction of fresh air. In consequence, the scavenging efficiency is remarkably improved and the rate of fuel consumption is decreased to decrease the thermal load on the engine, thereby to prolong the life of the engine.

According to another aspect of the invention, the fuel is supplied into an engine in each suction stroke in the heavy load operation range whereas, in the light and medium load operation ranges, the fuel supply to the engine is periodically suspended in successive suction strokes. It is, therefore, possible to make an efficient scavenging to expell the combustion gas and to promote the cooling of the cylinder in the suction stroke in which fresh air solely is supplied into the engine during light and medium load operation of the engine whereas, in the heavy load operation of the engine, the required high output power is maintained because of the regular supply of the fuel in each of successive suction strokes.

According to still another aspect of the invention, two intake passages are connected to the intake port of the engine and a switching valve is disposed for alternatingly opening and closing these intake passages in accordance with the revolution speed of the engine crank shaft. Therefore, the air fuel mixture and the fresh air solely are alternatingly supplied in accordance with the revolution of the engine crank shaft so that the eplosion and the suspension of explosion are made efficiently to improve the scavenging efficiency and to promote the cooling of the engine. This arrangement can apply to both two-cycle engines and four-cycle engines.

Furthermore, according to still another embodiment of the invention, air fuel mixture is supplied into the crank chamber through a first intake passage communicated with the crank chamber in accordance with the revolution speed of the engine whereas, from the second intake passage communicated with the scavenging passage, fresh air solely is supplied into the scavenging passage. It is, therefore, possible to concentrate the fresh air to the region around the scavenging passage so that the cylinder chamber is filled with the fresh air when the subsequent scavenging stroke is commenced, thereby to further improve the scavenging efficiency.

It is readily apparent that the above-described method and apparatus for supplying fuel meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An apparatus for supplying fuel to a two-cycle internal combustion engine having a rotating crankshaft in a crank chamber, comprising an intake port provided in said engine and open to said crank chamber of the engine, a single intake passage connected at one end to said intake port and at an opposite end leading to atmosphere, and means connected to an intermediate portion of said intake passage for supplying fuel to the latter and suspending fuel supply thereto, wherein said means comprises:

a carburetor disposed in the intermediate portion of said intake passage, said carburetor having a venturi portion, a float chamber and a fuel injection nozzle connecting between said venturi portion and said float chamber;

a stop valve for controlling injection of fuel into said intake passage through said fuel injection nozzle;

a valve actuator operatively connected to said stop valve; and a switch means disposed in a circuit connecting said stop valve and said value actuator, said switch means being operatively connected to said crankshaft of said engine to actuate said stop valve in accordance with revolution speed of said engine, such that said means acts to alternately admit air-fuel mixture and fresh air only, respectively, during alternate revolutions of said engine.

2. An apparatus as set forth in claim 1, wherein reed valve means is provided at the connection between said intake port and said intake passage.

3. An apparatus as set forth in claim 1, wherein said means operates to alternatingly supply fuel to the engine and suspend fuel supply to the engine in successive suction strokes.

4. An apparatus as set forth in claim 1, wherein said means operates to supply fuel to the engine in each of successive suction strokes in a heavy load range of operation of the engine and for alternatingly supplying fuel and suspending fuel supply to the engine in successive suction strokes in a light or medium load range of operation of the engine.

5. An apparatus as set forth in claim 1, wherein said engine includes a cylinder and a cylinder block, and a scavenging passage is formed in the side wall of the cylinder block of the engine for connection between the crank chamber and the cylinder.

6. An apparatus as set forth in claim 1, wherein said stop valve is disposed at an intermediate portion of said fuel injection nozzle to open and close said nozzle in accordance with the revolution speed of said engine.

7. An apparatus as set forth in claim 6, wherein reed valve means is provided at the connection between said intake port and said intake passage.

8. An apparatus as set forth in claim 6, wherein said means operates to alternatingly supply fuel to the engine and suspend fuel supply to the engine in successive suction strokes.

9. An apparatus as set forth in claim 6, wherein said means operates to supply fuel to the engine in each of successive suction strokes in a heavy load range of operation of the engine and for alternatingly supplying fuel and suspending fuel supply to the engine in successive suction strokes in a light or medium load range of operation of the engine.

10. An apparatus as set forth in claim 6, wherein said engine includes a cylinder and a cylinder block, and a scavenging passage is formed in the side wall of the cylinder block of the engine for connection between the crank chamber and the cylinder.

11. An apparatus for supplying fuel to a two-cycle internal combustion engine having a rotating crankshaft in a crank chamber, comprising an intake port provided in said engine and open to said crank chamber of the engine, a single intake passage connected at one end to said intake port and at an opposite end leading to atmosphere, and means connected to an intermediate portion of said intake passage for supplying fuel to the latter and suspending fuel supply thereto, wherein said means comprises:

a carburetor disposed in the intermediate portion of said intake passage, said carburetor having a venturi portion, a float chamber and a fuel injection nozzle connecting between said venturi portion and said float chamber;

a stop valve for controlling injection of fuel into said intake passage through said fuel injection nozzle; and a valve actuator operatively connected to said stop valve wherein said stop valve is disposed at an intermediate portion of said fuel injection nozzle, said carburetor is a piston-valve or slide type having a throttle valve adjusted to adjust the amount of fuel injected from the fuel injection nozzle, and a switch means is disposed in a circuit connecting said stop valve and said valve actuator and is also associated with said throttle valve, said switch means operating such that it cuts off connection between the said stop valve and said valve actuator when the throttle valve is in substantially full open position to keep said stop valve open at all times whereas when the throttle valve is in less than substantially full open position, the switch means establishes connection between said stop valve and valve actuator to let the stop valve open and close in accordance with revolution speed of said engine such that said means acts to alternately admit air fuel mixture and fresh air only, respectively, during alternate revolutions of said engine.

12. An apparatus as set forth in claim 11, wherein reed valve means is provided at the connection between said intake port and said intake passage.

13. An apparatus as set forth in claim 11, wherein said means operates to alternatingly supply fuel to the engine and suspend fuel supply to the engine in successive suction strokes.

14. An apparatus as set forth in claim 11, wherein said means operates to supply fuel to the engine in each of successive suction strokes in a heavy load range of operation of the engine and for alternatingly supplying fuel and suspending fuel supply to the engine in successive suction strokes in a light or medium load range of operation of the engine.

15. An apparatus as set forth in claim 11, wherein said engine includes a cylinder and a cylinder block, and a scavenging passage is formed in the side wall of the cylinder block of the engine for connection between the crank chamber and the cylinder.

* * * * *